US008122528B2

(12) United States Patent
Heisterhagen

(10) Patent No.: US 8,122,528 B2
(45) Date of Patent: Feb. 28, 2012

(54) SHOWER DEVICE

(75) Inventor: Jan Heisterhagen, Schutterwald (DE)

(73) Assignee: Hansgrohe AG, Schiltach (DE)

( * ) Notice: Subject to any disclaimer, the term of this patent is extended or adjusted under 35 U.S.C. 154(b) by 1140 days.

(21) Appl. No.: 11/817,283

(22) PCT Filed: Feb. 4, 2006

(86) PCT No.: PCT/EP2006/000995
§ 371 (c)(1),
(2), (4) Date: Nov. 14, 2007

(87) PCT Pub. No.: WO2006/094587
PCT Pub. Date: Sep. 14, 2006

(65) Prior Publication Data

US 2008/0313802 A1 Dec. 25, 2008

(30) Foreign Application Priority Data

Mar. 4, 2005 (DE) ..... 10 2005 011 294

(51) Int. Cl.
*A47K 3/20* (2006.01)
*A47K 4/00* (2006.01)

(52) U.S. Cl. ..... 4/567

(58) Field of Classification Search ..... 4/567, 538, 4/596, 615–618
See application file for complete search history.

(56) References Cited

U.S. PATENT DOCUMENTS

| | | | | |
|---|---|---|---|---|
| 5,788,160 | A | 8/1998 | Woog et al. | |
| 6,415,461 | B1 * | 7/2002 | Singer | 4/601 |
| 2004/0217196 | A1 * | 11/2004 | Yurek et al. | 239/289 |

FOREIGN PATENT DOCUMENTS

| | | | |
|---|---|---|---|
| DE | 1272242 | B | 7/1968 |
| DE | 2815661 | A1 | 12/1978 |
| DE | 4137313 | A1 | 5/1993 |
| DE | 29604312 | U1 | 6/1996 |
| DE | 20304879 | * | 6/2003 |
| DE | 20304879 | U1 | 6/2003 |
| EP | 0735205 | A | 10/1996 |
| EP | 1384828 | * | 1/2004 |
| EP | 1384828 | A | 1/2004 |

* cited by examiner

*Primary Examiner* — Lori Baker
(74) *Attorney, Agent, or Firm* — Duane Morris LLP

(57) ABSTRACT

A shower device is attached to a wall and is not connected in a fixed manner to the interior shower or to an additional hand shower. A hose that extends from a plumbing fixture to a hand shower is used for supplying the shower device or hand shower. The hand shower has an outlet for water discharged from the hose. The outlet can be joined to an inlet into the shower device such that the water reaches the shower device via the hand shower. The shower device can be configured as a wall-mounted rod. Preferably, the connection that redirects the water is established by a mechanical coupling device.

21 Claims, 5 Drawing Sheets

SHOWER DEVICE

BACKGROUND

Figure 1:
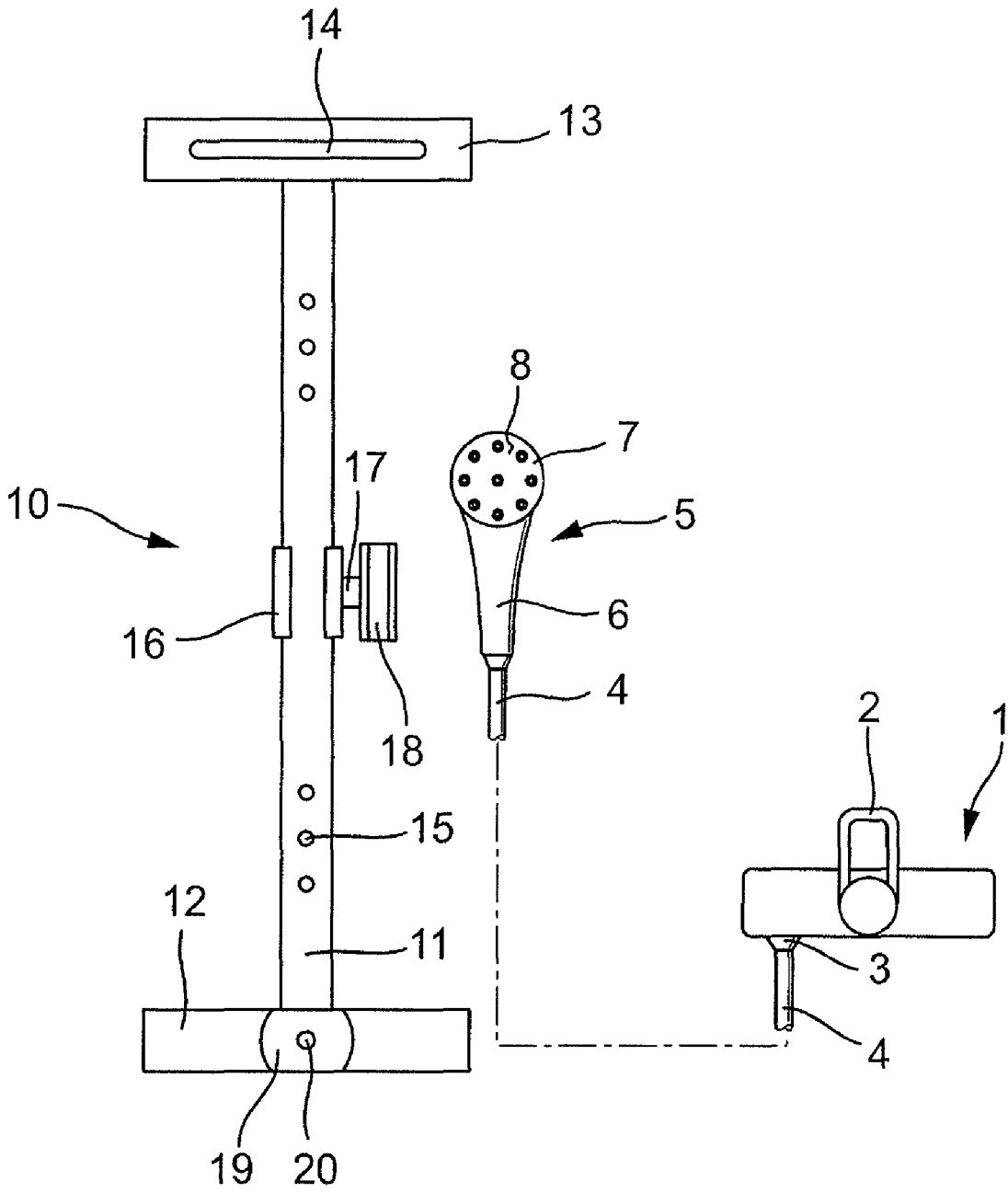

The invention relates to a shower device with a plumbing fixture in which a plumbing valve is provided and used, among other purposes, for activating a shower hose connection.

During renovation of bathrooms, the problem can arise that one would like additional devices for showering but there is little or no possibility of installing full lines under the respective shower surfaces. For this purpose, it is already common to design a side shower for retrofit installation (DE 29604312) such that a shower rail, deriving its water via a hose that is held by the plumbing fixture, is provided for a side shower. The connection to the wall-mounted rail then consists of a further changeover valve, so that the normal hand-held showerhead can be connected via a further means. In this manner, the quantity and temperature of the water for the side shower can be controlled via the already existing fixture, while a changeover valve exists elsewhere for changing between the side shower and the hand-held showerhead.

SUMMARY

An object of the invention is to provide a possibility of being able to activate an additional shower device via an existing plumbing fixture.

To achieve this object the invention proposes a shower device and a hand-held showerhead, with the features mentioned in the appended claims.

The hand-held showerhead belonging to the plumbing fixture also features an additional outlet connection to its normal jet outlet element that can be connected with an inlet connection of a further shower device.

When this outlet connection is connected with the inlet connection of further shower devices, the further shower device can be activated by means of the plumbing fixture. Therefore, no further manually operated plumbing valve is required, for instance, in order to change or set the amount and/or the temperature of the water flowing to the other shower device. Only an additional valve is required to open or close the outlet connection of the hand-held showerhead.

The other shower device can be an additional device besides the hand-held showerhead, for instance a supplement to the hand-held showerhead with a different jet type or a different shape or feature a different type of handling. This additional showerhead can be handled together with the hand-held showerhead, or also feature its own handle that can be used to operate the additional hand-held showerhead and the hand-held showerhead.

In further development of the invention, it can be provided that the hand-held showerhead features a mechanical coupling device for mechanically coupling the hand-held showerhead to the other shower device.

In particular, it can be provided that the coupling device is formed in such a way that in the mechanical connection between the hand-held showerhead and the other shower device the outlet connection of the hand-held showerhead is hydraulically connected simultaneously with the inlet connection of the other shower device. This makes it possible to establish the liquid connection between the two parts simultaneously by means of a simple mechanical connection process.

As already mentioned, a valve can be provided for opening the outlet connection. This valve, for instance, allows operation by means of an activating element to be activated manually. Then the user can deliberately establish the liquid connection.

The valve can for instance be located inside the hand-held showerhead itself. It can be formed and mounted as a common valve for switching over between different jet-types of a hand-held showerhead so that previous solutions of valves located in hand-held showerheads can be used further.

It is also considerable and within the scope of the invention that valves for opening the outlet connection of the hand-held showerhead be located inside the plumbing fixture itself. In this case, for instance, a hose with two water lines can be used.

It is also possible that the valve is accommodated inside the hand-held showerhead, but its activating element is mounted inside the plumbing fixture.

A further possibility proposed by the invention is that the valve for opening and shutting the outlet connection can be activated by establishing or disconnecting a mechanical connection with the inlet connection of the shower device. The user must not perform additional activities in order to activate further shower devices.

For instance, the mechanical connection that at the same time establishes the liquid connection can be executed as plug-in coupling so that the outlet connection in the hand-held showerhead forms a part of this plug-in coupling, of which the other part is mounted in the other shower device. Plug-in couplings are actually known so that familiar solutions are used, whereby an adaptation to the special application case in question here can be carried out if necessary.

The valve that opens and shuts the outlet connection of the hand-held showerhead, for instance, in further development can be formed so that when the outlet connection is open, the water supply to the jet outlet element is at least partly switched off. In addition, a full shut-off means can be provided. This means that upon establishing the connection between the hand-held showerhead and the other shower device, the water is then only supplied or first supplied to the other shower device.

It is however considerable and within the scope of the invention that the valve is formed in such a way that when the outlet connection is open, the water supply to the jet outlet element of the hand-held showerhead remains sustained. In a mechanical coupling between the hand-held showerhead and the other shower device, depending on the attachment and formation of the other shower device, the hand-held showerhead can still be used as an overhead shower or side shower.

According to the invention, it can be provided in a further development that the outlet connection and/or the coupling device are/is arranged on the hand-held showerhead such that when connected with the other shower device the jet outlet element points in a direction facing the user. This is then reasonable when the jet outlet element should further be used for showering.

In further development, it can be possible that the coupling device features a water delivery plug-in nipple. The same can for instance be covered when the hand-held showerhead is not coupled, so that it is first exposed upon establishing the mechanical connection. A sleeve or a similar element can serve for this purpose, which can also feature additional functions, for instance, function as an element for holding the hand-held showerhead when said is not in use.

The invention proposes, in further development, to connect the described shower device with a shower device connected and mechanically coupled with this outlet connection of the hand-held showerhead.

This can particularly feature a shower device that does not have its own liquid connection with a house installation.

Preferably, this however involves a shower device that is independently fastened mechanically to a wall or to any other part of the fitting in a bathroom, a shower cell or the likes.

It was mentioned at the beginning that the activation of a wall-mounted rail with the help of a hose is already known. The additional shower device proposed by the invention, which is connected with the hand-held showerhead, can be any shower device, for instance, also a wall-mounted rail that can serve for holding the side shower.

For instance, in further development of the invention the wall-mounted rail can additionally serve as a normal wall-mounted rail, in that it can feature a preferably displaceable holder for the hand-held showerhead, so that this can be used as a showerhead even without operation of the wall-mounted rail.

In further development of the invention, it can be provided that the wall-mounted rail is made hollow so that it can internally serve as a water carrier.

In further development of the invention, it can be provided that the inlet connection of the shower device formed as a wall-mounted rail and/or of the part of the coupling device associated with the wall-mounted rail is located in the lower end area of the wall-mounted rail.

According to the invention, it can be provided that the other shower device at least features an overhead shower. By plugging the hand-held showerhead into the coupling device, the showerhead can be supplied with water.

The wall-mounted rail can also feature at least one side shower.

The shower device can feature its own changeover valve for switching over between the showerhead and side shower.

The quantity of water exiting the showerhead or the side shower as well as its temperature is furthermore controlled or determined by the plumbing valve inside the plumbing fixture.

According to the invention, it can be provided that a console is located in the bottom end area of the wall-mounted rail that features the parts of the connection and/or the coupling device. The console can feature or form additional function elements, for instance, tray possibilities for articles needed or desired when showering.

The invention likewise proposes a shower device for fixing on a wall or on another part of a shower cabinet, which at least features a jet outlet element, an inlet connection for connection with an outlet connection of a hand-held showerhead as well as a water carrier from the inlet connection to the at least one jet outlet element.

This shower device can be formed as a wall-mounted rail; it can also feature a mechanical coupling device for mechanically coupling a hand-held showerhead.

The invention likewise proposes a hand-held showerhead with a connection for a shower hose, at least a jet outlet element and a selectively opened outlet connection for connection with an inlet connection of a shower device.

BRIEF DESCRIPTION

Figure 2:
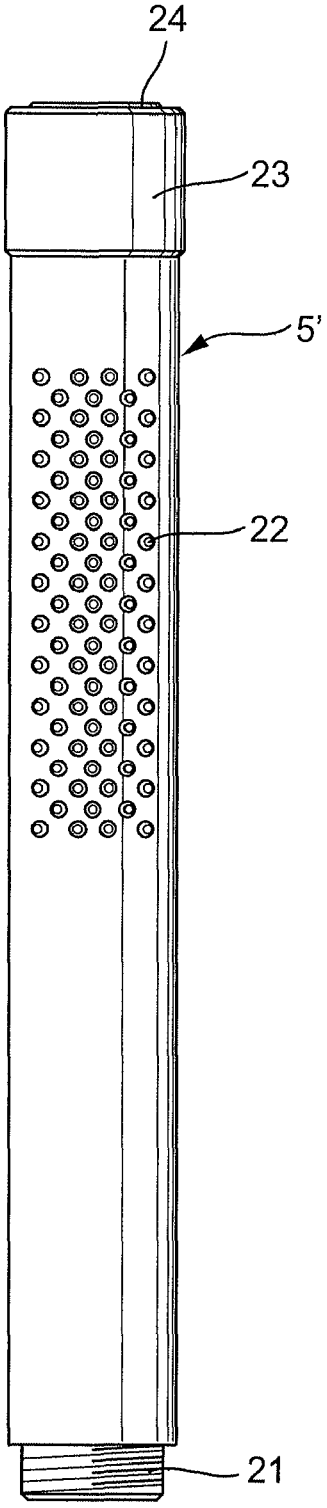
Figure 3:
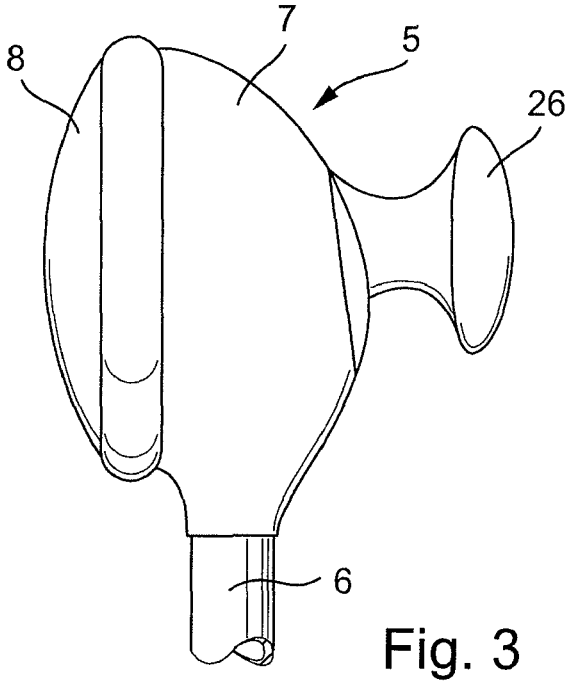
Figure 4:
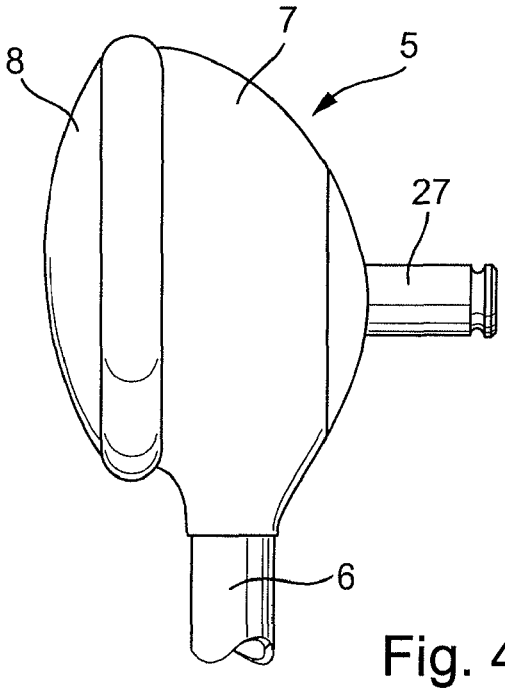
Figure 5:
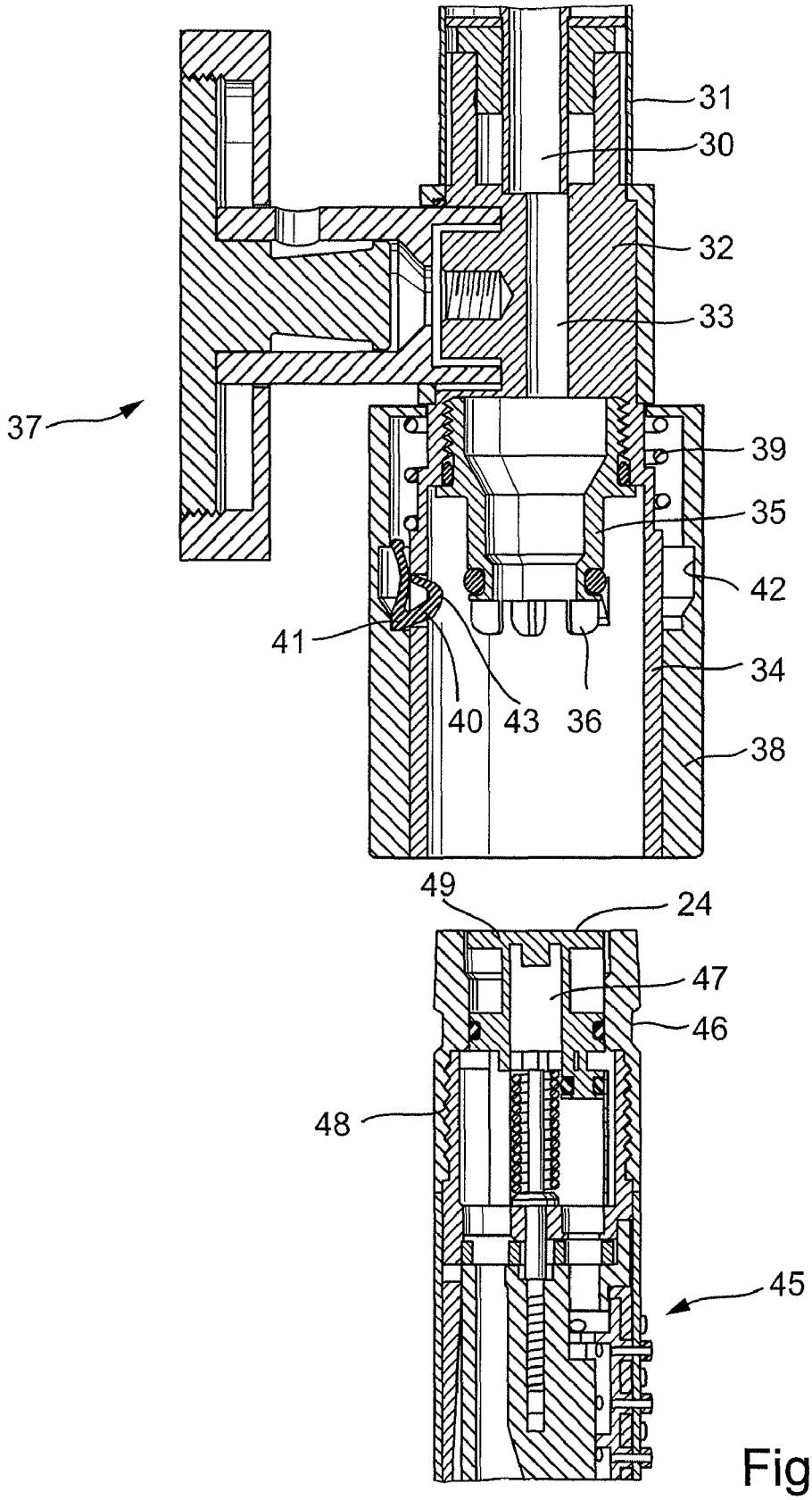
Figure 6:
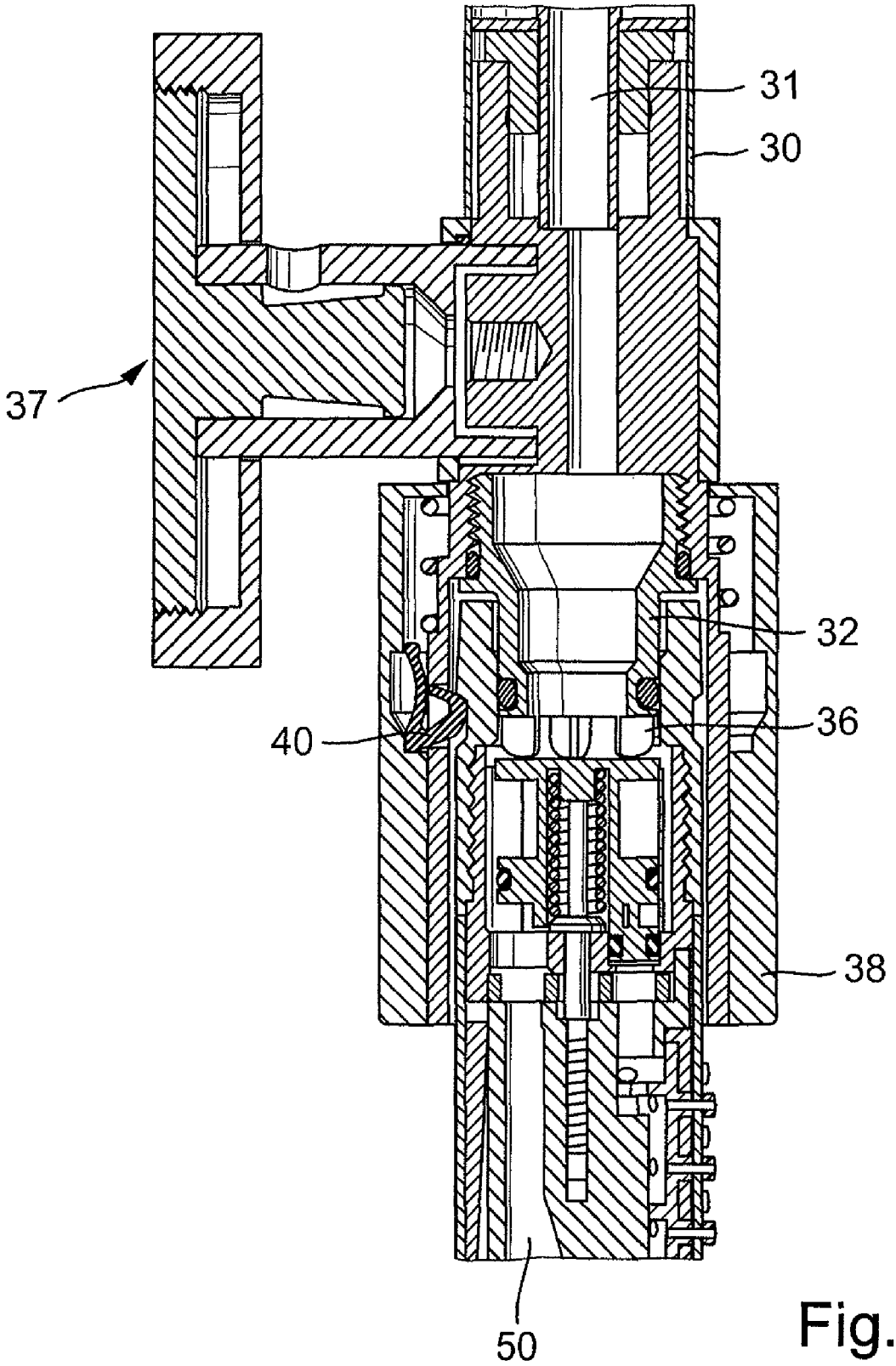
Figure 7:
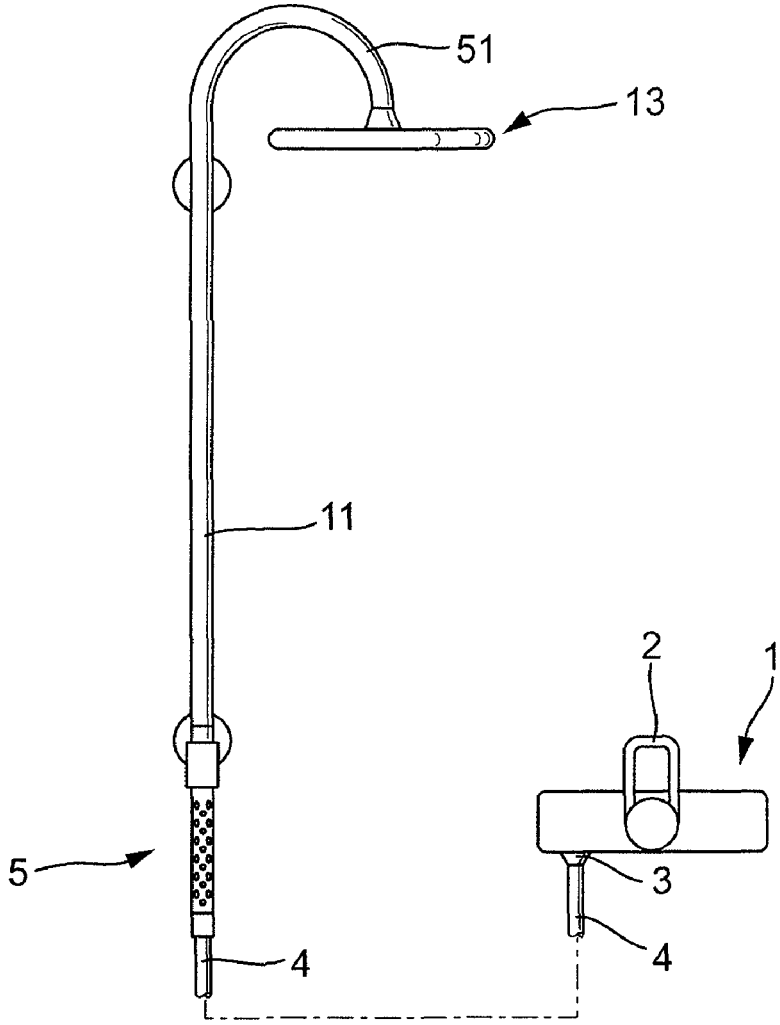

Features, details and preferences of the invention including those stated above, are derived from the claims and the abstract, of which the wording refers to the content of the description, and of the following description of a preferred embodiment as also shown in the drawing. The following figures show:

FIG. 1 purely schematically, the overview of the invention;

FIG. 2 a side view of a hand-held showerhead, which can be used for the shower device of FIG. 1;

FIG. 3 a side view of a further hand-held showerhead;

FIG. 4 the hand-held showerhead of FIG. 3 in a ready state for connection with the wall-mounted rail;

FIG. 5 a longitudinal section through a coupling device between a wall-mounted rail and the hand-held showerhead of FIG. 2;

FIG. 6 a section corresponding to FIG. 5 of the two parts in a connected state;

FIG. 7 an illustration of the shower device corresponding to FIG. 1, which is particularly suitable for the hand-held showerhead of FIG. 2.

Figure 8:
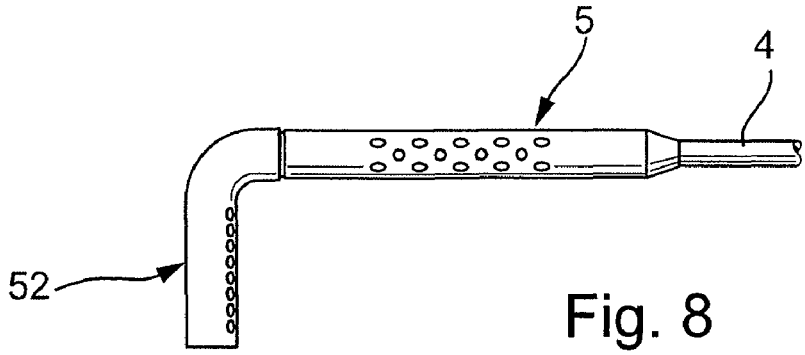

FIG. 8 the side view of a hand-held showerhead with another shower device in the form of an additional showerhead.

DETAILED DESCRIPTION

FIG. 1 shows the parts in a strongly simplified schematic illustration, with whose help the invention should be clarified. A plumbing fixture 1 in which a plumbing valve is accommodated is attached at an arbitrary point of a bathroom. For instance, this involves a thermostatic valve that should be operated with the help of an activating element 2. From the plumbing fixture 1, a connection 3 for a shower hose 4 leads outwards. At the end of the shower hose 4 a hand-held showerhead 5 is connected, which features a grip 6 and a showerhead 7. On the front-side of the showerhead 7, visible in FIG. 1, a jet outlet element in the form of a jet disc 8 is located, which is provided with different jet outlet openings.

Independent of the plumbing fixture 1 a further shower device 10 is attached in the bathroom, for instance, on the wall. This further shower device 10 has no water connection to the house installation, is however fastened independent of the plumbing fixture 1.

The other shower device contains a wall-mounted rail 11 that is formed as a hollow pipe. The cross-section deviates preferably from the round shape. The wall-mounted rail 11 stretches between a console 12 located at its bottom end and an overhead shower 13 located at its top end, whereby the illustrated example entails a splash shower, in which the water exits out of a slit 14 in the form of a thin fan.

On the front side of the wall-mounted rail 11, visible in FIG. 1, individual jet outlet openings 15 are formed, which are connected with the inner side of the wall-mounted rail 11. A holder 16 is provided on the wall-mounted rail 11, which partly surrounds the wall-mounted rail 11, and is able to slide in the longitudinal direction of the wall-mounted rail. It can be fixed in an arbitrary position, for instance, by means of internal material stress, of which the holder 16 is made. On its side, a common conical holder 18 is attached via a rotary connection 17. The grip 6 of the hand-held showerhead 5 can be stuck in this conical holder 18. The wall-mounted rail 11 can be used in this manner like a common wall-mounted rail.

The holder 16 is formed such that it leaves the middle area free, thus the front side of the wall-mounted rail 11, in which the jet outlet elements 15 are located.

In the console 12, a depression is formed in the middle 19, in whose middle point a socket 20 is visible. This socket 20 forms an inlet connection for water and is connected with the hollow internal side of the wall-mounted rail 11.

The invention now proposes that the hand-held showerhead 5 be provided with an outlet connection that can be connected with the socket 20 of the wall-mounted rail 11 such that the water conveyed through the shower hose 4 can reach the interior of the wall-mounted rail 11. This shall first be explained in FIG. 2 with a hand-held showerhead that deviates in the form from the one explained in FIG. 1. The hand-held showerhead 5 dashed in FIG. 2 is not considered for the wall-mounted rail 11 of FIG. 1, but for another wall-mounted rail. The hand-held showerhead 5 features the shape of a thin cylinder. On its bottom end is a thread 21 for connection of the union nut depicted at the end of the shower hose 4. In the jacket surface of the cylinder a field with individual jet outlet elements 22 is formed. These jet outlet elements 22 are oriented such that they do not all produce parallel jets but that the opening angle of the produced jet fan is nonetheless smaller than the circumference of the field.

On the end of the hand-held showerhead 5 facing away from the connection for the shower hose 4 a rotatable ring element 23 provided, which forms an activating element for a changeover valve located in the internal part of the hand-held showerhead 5. An outlet connection for the water guided through the shower hose 4 is located in the face side 24. This can involve a socket that interacts with a nipple of a wall-mounted rail. The example of FIG. 2 was selected in order to show that the arrangement of an outlet connection on a hand-held showerhead, as the invention proposes, does not need to impair the design of the hand-held showerhead in its external appearance. The hand-held showerhead can be used and applied exactly as before. In a wall-mounted rail, which should be used with the hand-held showerhead according to FIG. 2, one would lay the inlet connection reasonably on the bottom side so that the hand-held showerhead is located in the extension of the wall-mounted rail. It is naturally also considerable, in the case of a wall-mounted rail with the form illustrated in FIG. 1 to attach the hand-held showerhead of FIG. 2 on the bottom side of the showerhead 13, which would have the side effect that the hand-held showerhead simultaneously serves as side shower.

The FIGS. 3 and 4 now show a hand-held showerhead, which is specially meant for the wall-mounted rail of FIG. 1, thus for coupling in the cutout 19 in the console 12. As already mentioned, the hand-held showerhead contains a showerhead 7 with a spray disc 8. The jet outlet elements or jet openings are not depicted here.

On the rear side of the showerhead 7, there is a projection 26, which features the shape of a button. With this projection 26, the hand-held showerhead may be hung on a corresponding holder. The projection 26 is formed such that it can be pushed into the housing of the showerhead 7 by pressing its rear side, see FIG. 4. Thereby, the nipple 27 with the water line inside the showerhead 7 remains standing, which is meant for engagement inside the socket 20 in the console 12.

Now as regards another embodiment that is depicted in the FIGS. 5 and 6. The FIGS. 5 and 6 show in their upper part the lower end of a wall-mounted rail 30, which in its interior features a water line 31 formed by a hose. In the bottom end of the wall-mounted rail 30 a plug 32 is inserted, which features a continuous channel 33. The plug 32 then forms a sleeve 34 in the bottom area in which a nipple 35 is screwed. The hollow nipple 35 features in the area of its free end individual webs 36, which form interstices between themselves.

The plug 32 is firmly screwed with the help of a wall holder 37 on the wall. This wall holder also serves for holding the wall-mounted rail 30 with the help of the plug 32.

An external sliding sleeve 38 is attached over the sleeve 34, which is pushed upwards by a contacting spring 39 onto a shoulder of the sleeve 34, that is, in the direction towards the plug 32. Between the sleeve 34 and the sliding sleeve 38 is an inserted swivel hook 40, which, in the depicted position, protrudes inside the interior space of the sleeve 34. If the sleeve 38 is shifted downwards against the effect of the spring 39 in FIG. 5, then the radial exterior 41 of the swivel hook 40 enters a groove 42, where the interior of the sliding sleeve 38 features a larger diameter. Through this, the swivel hook 40 allows being swivelled outwards so that its inner edge 43 is pushed from the inner part of the sleeve 34 outwards.

An end of a hand-held showerhead 45 acts together with the inner side of the sleeve 34, which is depicted in the section of FIG. 5 in its end area. It involves a hand-held showerhead that is similar in design to the hand-held showerhead 5 in FIG. 2. The end of the hand-held showerhead 45 contains a circumferential groove 46 that features a certain distance from the face end. If the hand-held showerhead is pushed into the sleeve 34, then the swivel hook 40, of which there are several besides the one depicted in FIG. 5, enters this groove 46 and hence locks the hand-held showerhead in the sleeve 34. A valve 47 is accommodated in the end area of the hand-held showerhead, which is closed by the effect of a spring 48 in a normal state.

After pushing in the hand-held showerhead, the position depicted in FIG. 6 occurs. The end of the valve closing plate 49 lies on the external ends of the webs 36. These push the valve closing plate 49 so far in the inner part of the hand-held showerhead such that the valve is opened. The water passing through the hand-held showerhead and its water line 50 flows past the valve closing plate 49 and through the interstices between the webs 36 into the inner part of the plug 32.

From there, the water reaches the water line 31 of the wall-mounted rail 30.

To loosen the connection, the sliding sleeve 38 in FIG. 6 is pushed downwards so that the swivel hook 40 is out of engagement with the groove 46. Then the hand-held showerhead again allows itself to be pulled out of the inlet connection of the wall-mounted rail 30.

FIG. 7 shows an illustration corresponding to FIG. 1, in which the hand-held showerhead 5 features the form of the hand-held showerhead of FIG. 2. With its front face end, it is fitted in the axial inlet connection of a wall-mounted rail 11, which is formed as a round pipe continuing the shape of the hand-held showerhead 5. In the area around its upper end, the pipe transforms into an elbow 51 in the head shower 13, which in this case features the shape of a flat disc with a large jet outlet surface.

FIG. 8 shows the above mentioned possibility that the other shower device involves an attachment 52 for the hand-held showerhead, for instance, an additional showerhead, which in this case provides its jets in different direction from that of the hand-held showerhead 5. In the case of the attachment 52 for the hand-held showerhead 5, which is connected in the same manner with the hand-held showerhead 5 as the wall-mounted rail 11, the embodiment according to FIG. 7 can also involve for instance a showerhead equipped with brushes.

What is claimed is:

1. A shower device comprising:

a plumbing fixture, a plumbing valve located inside the plumbing fixture, a shower hose connection that can be activated by the plumbing valve, a hand-held showerhead that is connected via a shower hose and features at least one jet outlet element and also features an outlet connection that is selectively openable for coupling with an inlet connection of one of an other shower device and an attachment shower device, wherein the hand-held showerhead features a mechanical coupling device for connection of the hand-held showerhead to the shower device, and wherein the coupling device is formed such that upon making a mechanical connection between the hand-held showerhead and the shower device, an outlet connection of the hand-held showerhead is also connected with the inlet connection of the other shower device, a shower device connected to the outlet connection of the hand-held showerhead and mechanically coupled with the hand-held showerhead, wherein the shower device does not feature an independent connection with a house installation, wherein the shower device is formed as a wall-mounted rail, and wherein the wall-mounted rail is hollow in design and has an inner side that serves as a water line.

2. A shower device according to claim 1, wherein the outlet connection is opened by a valve.

3. A shower device according to claim 2, wherein the valve can be operated by a manually activated element.

4. A shower device according to claim 2, wherein the valve is located in the hand-held showerhead.

5. A shower device according to claim 2, wherein the valve is located in the plumbing fixture.

6. A shower device according to claim 2, wherein the valve is operable by establishing a mechanical connection between the hand-held showerhead and the inlet connection of the shower device.

7. A shower device according to claim 1, wherein the outlet connection of the hand-held showerhead features a part of a plug-in coupling, of which an other part is located inside the shower device.

8. A shower device according to claim 2, wherein the valve is formed in such a way that when the outlet connection of the hand-held showerhead is open, water supply to the jet outlet element of the hand-held showerhead is at least partially switched off.

9. A shower device according to claim 2, wherein the valve is formed in such a way that when the outlet connection of the hand-held showerhead is open, water supply to the jet outlet element of the hand-held showerhead is maintained.

10. A shower device according to claim 1, wherein the outlet connection from at least one of the hand-held showerhead and the coupling device is arranged on the hand-held showerhead such that when the connection is established between the hand-held showerhead and the shower device, the jet outlet element of the hand-held showerhead points in a direction facing a user.

11. A shower device according to claim 1, wherein the coupling device features a water delivery plug-in nipple.

12. A shower device, comprising a plumbing fixture, a plumbing valve located inside the plumbing fixture, a shower hose connection that can be activated by the plumbing valve, a hand-held showerhead that is connected via a shower hose and features at least one jet outlet element and also features an outlet connection that is selectively openable for coupling with an inlet connection of one of an other shower device and an attachment shower device, wherein the hand-held showerhead features a mechanical coupling device for connection of the hand-held showerhead to the shower device, wherein the coupling device features a water delivery plug-in nipple, and wherein the plug-in nipple is covered and is becomes exposed when the mechanical connection is established.

13. A shower device according to claim 12, wherein a covering element for the plug-in nipple is formed as a function element for the hand-held showerhead.

14. A shower device according to claim 1, wherein the shower device itself is mechanically fixed on a surface.

15. A shower device according to claim 1, wherein the wall-mounted rail features a holder for the hand-held showerhead not functionally connected with the hand-held showerhead.

16. A shower device according to claim 1, wherein the inlet connection is located at least at one of the wall-mounted rail and a part of a coupling device corresponding to the wall-mounted rail in an area at a bottom end of the wall-mounted rail.

17. A shower device according to claim 1, wherein the shower device features at least an overhead shower.

18. A shower device according to claim 1, wherein the shower device features at least a side shower.

19. A shower device according to claim 1, wherein the shower device features at least one of an overhead shower and a side shower that can be activated by means of the plumbing valve inside the plumbing fixture.

20. A shower device, comprising a plumbing fixture, a plumbing valve located inside the plumbing fixture, a shower hose connection that can be activated by the plumbing valve, a hand-held showerhead that is connected via a shower hose and features at least one jet outlet element and also features an outlet connection that is selectively openable for coupling with an inlet connection of one of an other shower device and an attachment for a shower device, and, a console in an area of a bottom end of the wall-mounted rail, wherein the console features part of at least one of the connection device and the coupling device.

21. A shower device according to claim 20, wherein the other shower device comprises an attachment for the hand-held showerhead.

* * * * *